US005309704A

United States Patent [19]

Grando

[11] Patent Number: 5,309,704

[45] Date of Patent: May 10, 1994

[54] METHOD OF PRODUCING CHAIN LINKS AND CHAIN LINKS PRODUCED THEREFROM

[76] Inventor: Stefano Grando, 1131 Alta Loma Rd., #501, Los Angeles, Calif. 90069

[21] Appl. No.: 916,793

[22] Filed: Jul. 17, 1992

Related U.S. Application Data

[63] Continuation of Ser. No. 629,120, Dec. 17, 1990, abandoned.

[51] Int. Cl.[5] ..... B21L 17/00

[52] U.S. Cl. ..... 59/13; 59/15; 59/16; 59/35.1

[58] Field of Search ..... 59/13, 15, 250, 16, 59/35.1, 1, 17; 29/412

[56] References Cited

U.S. PATENT DOCUMENTS 451,658 5/1891 Egge ..... 59/15
574,176 12/1896 Smith ..... 59/15
4,651,517 3/1987 Benhamou et al. ..... 59/16
4,934,135 6/1990 Rozenwasser ..... 59/80
4,996,835 3/1991 Rozenwasser ..... 59/80

FOREIGN PATENT DOCUMENTS 606526 11/1934 Fed. Rep. of Germany ..... 59/15
14648 9/1980 World Int. Prop. O. ..... 59/80

*Primary Examiner*—David Jones
*Attorney, Agent, or Firm*—Poms, Smith, Lande & Rose

[57] ABSTRACT

Links suitable for use in assembling rope chains are produced by utilizing a progressive series of punch and die sets which pierce and blank such links from a sheet of metal. If the metal sheet is in a long strip, the strip can be incrementally advanced through multiple series of punch and die sets so that several links can be created simultaneously. Because the links are die cut or stamped, the shape of the link can be arbitrary and can be a straight sided polygon such as a square, hexagon or octagon, or may be curvilinear such as a circle.

10 Claims, 3 Drawing Sheets

FIG. 5a
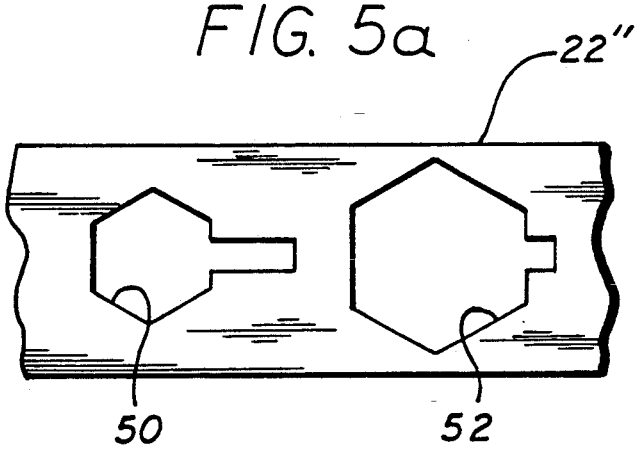
FIG. 5b
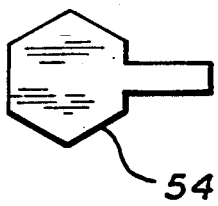
FIG. 5c
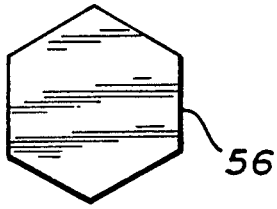
FIG. 5d
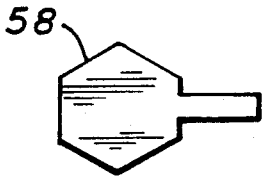
FIG. 5e
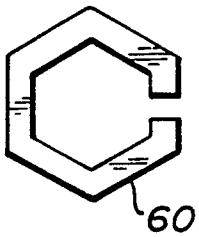
FIG. 6
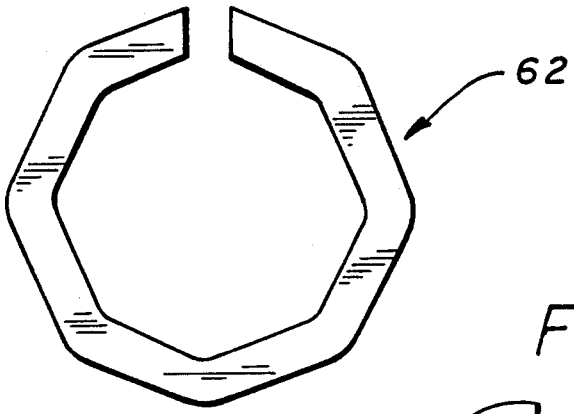
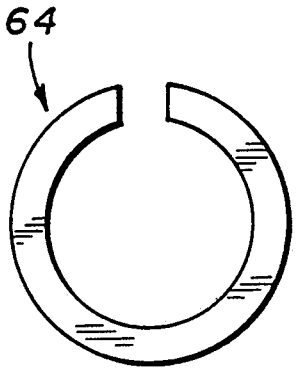
FIG. 7
FIG. 8
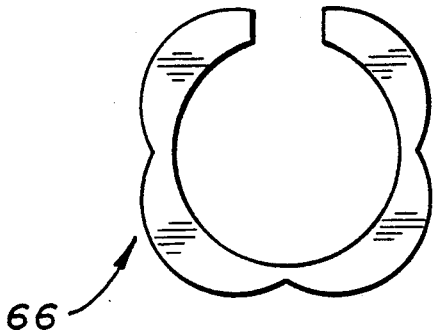

METHOD OF PRODUCING CHAIN LINKS AND CHAIN LINKS PRODUCED THEREFROM

This is a continuation of copending application Ser. No. 07/629,120, filed on Dec. 17, 1990, now abandoned.

The present invention relates to ornamental jewelry and more particularly, to a method for producing ornamental chain links for jewelry chains and the links produced by such method.

BACKGROUND OF THE INVENTION

For many years, decorative chain links made of precious and semiprecious metals have been made from wire. The wire may be round in cross section or may be formed with other cross sectional shapes such as rectangular or square.

Machines have been developed which take the wire and wind it around a mandrel of a desired shape into a helix and the individual coils are then cut from the helix. The resulting link is then flattened to be substantially planar and the link will be "open".

Automatic machines may continue the process by linking the flattened links into chains of various complexity and the individual links are then closed to prevent the chain from falling apart. Jewelry chains can be assembled with single links or multiple links on an automated basis.

A "rope" chain can be made using the same type of link but generally is manually assembled since multiple links, with alternating orientation, must be assembled. Selected ones of the links are soldered closed, rather than by compression of the link. Rope chains and their methods of assembly have been disclosed in the recent patents to Benhamou, et al U.S. Pat. Nos. 4,651,517, and Rozenwasser, No. 4,934,135.

Machines for producing "rope" chain of the prior art have been disclosed in the patents to Bucefari, et al, U.S. Pat. Nos. 4,493,183, and Allazetta, et al, No. 4,503,664. As noted in these patents, such machines use, as a starting material, a metal wire of preselected cross sectional area. During the manufacturing process, the individual links may be flattened to achieve a cross section that is other than circular.

RELATED APPLICATIONS

Recently, "rope chains" have been developed, the individual links of which were straight sided polygons such as squares, hexagons or octagons. Examples of such chains are shown in my copending applications for Letters Patent, Ser. Nos. 07/419,410, 07/439,512, 07/489,381 and 07/489,382. Initially, it was believed that these chains should be constructed according to prior art techniques using links and that were of wire that were shaped using an appropriate mandrel. It is known that Also, it is possible to draw or extrude wire in the appropriate cross sectional shape using drawing dies or other known techniques.

Other examples of "straight sided" chains are shown in the WIPO Patent No. DM/014,648, to S.I.L.0. s.P.a. of Italy (corresponding to the U. S. application Ser. No. 07/491,607 of Chiaramonti, et al.) which teaches a variety of chains using hexagonal links. A further example of a chain using straight-sided links is disclosed in the catalog of Unoaerre Italia s.P.a. of Arezzo, Italy, which catalog is believed to have been published in May of 1988.

A problem inherent in the use of conventional, round wire to make chain links of polygonal shape is the difficulty in achieving substantially sharp corners or apices where the straight sides are joined. Even though a wire can be bent around a properly shaped mandrel, the malleability of the metal results in a "rounded" corner or apex which may, through further working, be shaped into the desired, sharp corner. Even if the "sides" of a round wire link are "flattened", "rounded" "inner" and "outer" surfaces will still result.

Alternatively, the wire link may be originally shaped on a mandrel and the link can be diamond cut or planed to achieve the straight sides and sharp corner if the wire is thick enough at the outset. However, additional process steps are required and, if precious metals are used, substantial waste is created which must be recovered and reclaimed, at additional cost and expense.

Even the use of "square" or other specially drawn or extruded wire does not solve the problem in that the bending process tends to deform the wire and the original shape can only be retained with exceptional difficulty. Moreover, excessive tension may be required to prevent "bowing" as the wire is wrapped about a mandrel.

What is needed to create links with planar surfaces and sharp corners, both in cross section and in the finished link, is an inexpensive, method or process that is easily carried out, does not require substantial labor and which produces uniform links on a substantially continuous basis. Further, such a method should be susceptible to machine operation with little or no waste of the precious or semi precious metals that are used.

BRIEF SUMMARY OF THE INVENTION

According to the method of the present invention, a sheet of precious metal is provided of preselected thickness. Progressive punch and die sets are prepared which will produce the shape of the desired link. In successive steps, links are pierced and blanked from the sheet. The resulting links will be of proper thickness and will have all surfaces either in parallel planes or in planes that are orthogonal to the parallel planes.

The die cut links will each have a gap of proper width, either in the straight side of the link or at one corner or apex of the polygon. Alternatively, the method of the present invention can be applied to the manufacture of circular links or other links of simple or complex curvilinear shape.

This process may be considered die cutting or stamping of the individual links. As a result of utilizing the process, there is no problem of undue stresses on the metal or the need to perform other metal working operations on the link to achieve a flat link with flat, parallel sides and flat edges. This is important when using metals with some resiliency or if the working of the metal can result in a partial deformation of another part of the link.

Although the process has been most effective in producing links having straight sides, it is clear that links of virtually any arbitrary, complex shape can be created so long as they can be represented in two dimensions. The punch and die sets that are utilized in the present invention can take on any arbitrary shape and links having such an arbitrary shape can be reliably and exactly reproduced in large quantities.

Once produced, the link of the present invention can be assembled into a rope chain using any of the traditional methods, including those described in the patents to Benhamou et al, or Rozenwasser. Alternatively, these links may be fed into an appropriate rope chain machine which should be able to utilize the links in an automated assembly process.

The scrap that remains after the piercing and blanking operations is easily reclaimed and reprocessed into new metal sheets of the appropriate dimensions. Alternatively, the scrap strip can be used to make a series of links of graduated size so that different sized chains can be created, after the proper thickness is achieved by additional production steps.

BRIEF DESCRIPTION OF DRAWINGS

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

FIG. 2, including

FIG. 5, including FIGS. 5*a*–5*e* is a top view of a strip from which another alternative link has been produced by the process of the present invention, as well as the punches, the scrap and the link;

FIG. 6 is a top view of an octagonal link that can be produced by the process of the present invention;

FIG. 7 is a top view of a circular link that can be produced by the process of the present invention; and FIG. 8 is a top view of an alternative link of arbitrary shape that can be made according to the process of the present invention.

DETAILED DESCRIPTION OF THE DRAWINGS

Figure 1:
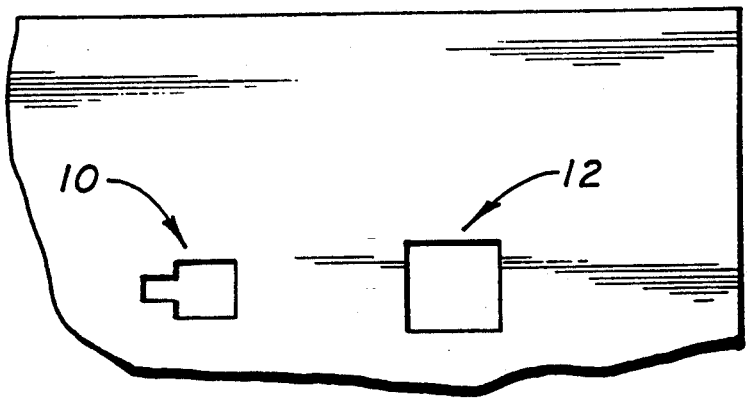
FIG. 1 is a top view of the dies of progressive punch and die sets suitable for producing a chain link according to the present invention.

Turning first to FIG. 1, there is shown the die portions 10, 12 of progressive punch and die sets suitable for use in the present invention. Shown in FIG. 1 is the apparatus for producing a square link with an aperture in one side, better seen in connection with FIG. 3, below. The first die 10, receives a piercing punch that shapes the interior of the link and the second die 12 receives the blanking punch that shears the link from a sheet of metal.

Figure 2A:
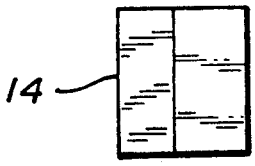
FIGS. 2*a* and 2*b* is a side view of the punch portions of the sets useful in the process of the present invention.
Figure 2B:
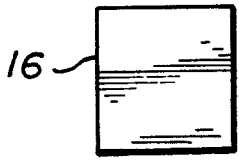

The corresponding punches are shown in FIG. 2, in which FIG. 2*a* shows a piercing punch 14 and FIG. 2*b* shows a blanking punch 16. It will be understood that the punches 14, 16 are designed to fit into their respective dies 10, 12 with no excess space between the walls of the dies and the punches.

As is well known in the art, the punches are intended to shear the metal along the line between the edge of the punch and the wall of die. It is important to transport the metal for a precise, predetermined distance so that the successive operations will produce the desired part.

Figure 3A:
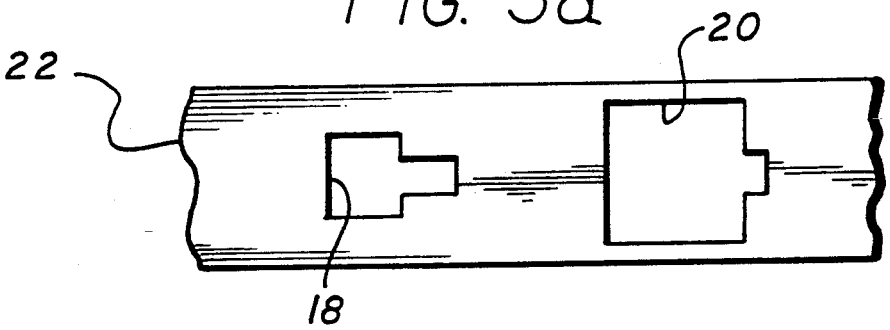
FIG. 3, including FIGS. 3*a*–3*c*, inclusive, is a top view of a typical strip from which a link has been pierced and blanked, as well as the scrap and the link itself.

In the present invention, as best shown in connection with FIG. 3, below, the first punch 14 cuts out the central portion 18 of a link and the second punch 16 cuts the finished link from the metal sheet, leaving an aperture 20 in the strip of metal 22. Successive links are created as the metal strip 22 is advanced in increments.

Figure 3B:
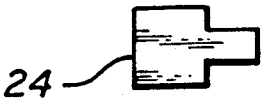

The punches can be mounted on the same press so as to pierce the strip 22 and simultaneously blank the portion of the strip 22 that was pierced in the prior operation. FIG. 3*b* shows the scrap piece 24 that results from the piercing step and FIG. 3*c* shows the finished straight sided link 26 that is the object of the process.

Figure 3C:
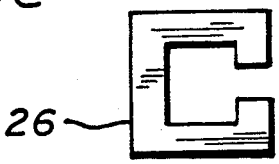
Figure 4A:
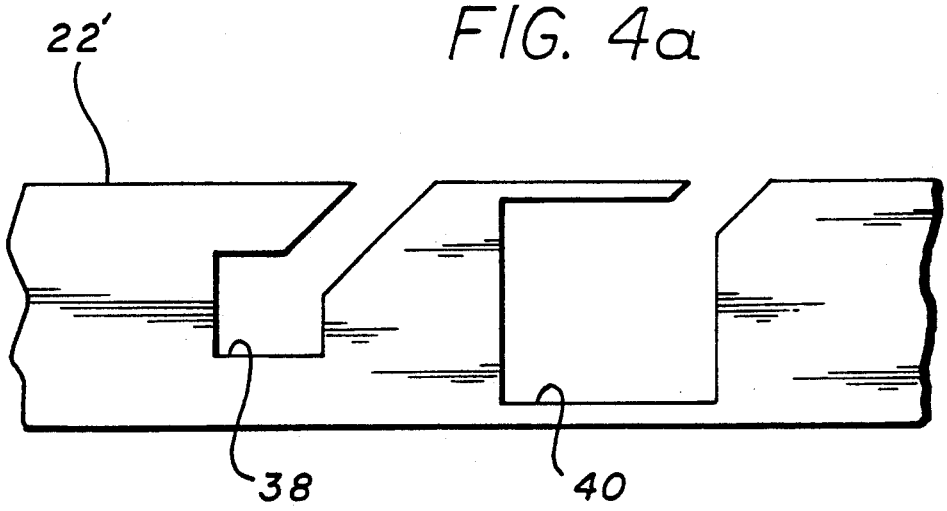
FIG. 4, including FIGS. 4*a*–4*e*, inclusive, is a top view of a typical strip from which an alternative link has been pierced and blanked, as well as the punches of the sets, the scrap and link, itself, according to the method of the present invention.

For a straight sided link of a different shape, it is possible to rotate the link of FIG. 3*c* by 45° and provide an opening in the corner of a link, rather than in a side. This embodiment is illustrated in FIG. 4. FIG. 4*a* shows the metal strip 22' in which a first, piercing operation has taken place leaving an aperture 38 and a second, blanking operation has resulted in the second aperture 40.

Figure 4B:
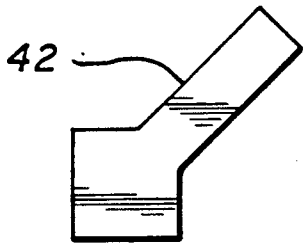
Figure 4C:
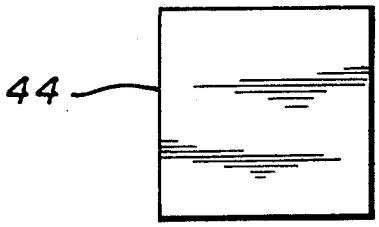
Figure 4D:
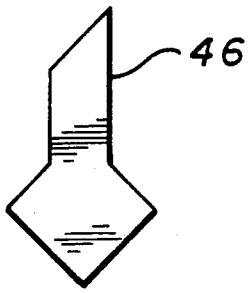
Figure 4E:
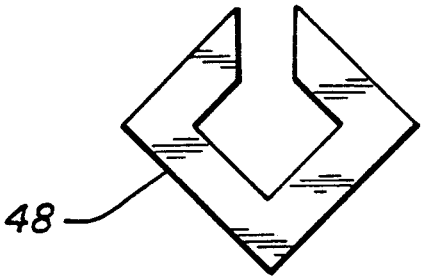

FIG. 4*b* shows the shape of the piercing punch 42 and, similarly, FIG. 4*c* shows the shape of the blanking punch 44. The scrap piece 46 resulting from the piercing step is shown in FIG. 4*d* and the finished link 48 is shown in FIG. *4e*.

A further, alternative straight sided link can be produced using the process of the present invention. FIG. 5 illustrates the apparatus useful in creating a hexagonal link with an aperture in one of the sides of the link. As with the earlier figures, FIG. 5*a* shows a strip 22" with apertures 50, 52 resulting from piercing and blanking steps, respectively. FIG. 5*b* shows the piercing punch 54 for the hexagonal link and FIG. 5*c* shows the blanking punch 56. The piercing step scrap piece 58 is shown in FIG. 5*d* and the finished hexagonal link 60 is shown in FIG. 5*e*.

In accordance with the present invention, other planar surfaced links of any desired shape, including circles and ovals, can be stamped or punched from a metal strip of the appropriate thickness. Suitable punch and die designs are within the skill of the artisan, once the basic process is understood. While a progressive sequence of two punch and die sets have been shown, it is also possible to mount several sets of piercing punches and dies at one station and several sets of blanking punches and dies at a second station and have the metal strip advance from the first station to the second station to produce a plurality of links with each operation.

Straight sided links are thus produced having flat, planar top and bottom surfaces, together with regular, straight cross sections having sharp corners. Such links, when assembled into chains of the type disclosed in my copending applications for patent, create a new and ornamental design that has heretofore been unavailable in a rope chain.

Alternatively, other arbitrary shapes can be envisioned that are capable of assembly into a rope chain. Such links could be circular, oval or other curvilinear shapes, such as lobed circles within the contemplation of the present invention, it being understood that such complex shapes are not easily formed from wire.

In FIG. 6, a flat, octagonal link 62, illustrating the various polygons that can be produced as links for a rope chain. Similarly, FIG. 7 shows a circular link 64, and FIG. 8 shows a multi lobed, generally circular link 66. As can be seen, the variety of shapes available is limited only by the imagination of the designer and the skill of the tool and die maker.

Accordingly, the scope of my invention should be limited only by the scope of the claims appended hereto.

I claim:

1. The process of producing a chain link suitable for use in a type of chain in which a plurality of links are intertwined to form what appears to be a double helix and which is commonly known as a "rope" chain comprising the steps of:

a. producing a sheet of metal of an appropriate thickness, determined by the size the link to be produced;

b. piercing said sheet with a first punch and die set having both a piercing punch and a first aperture therein of predetermined shaped to create the interior of the link and piercing said sheet with a blanking punch and a second die aperture therein of a predetermined shape to create the exterior of the link whereby said finished link is separated from said sheet, said finished link being produced with planar upper and lower surfaces and planar sides that are orthogonal to said surfaces.

2. The process of claim 1, above including the step of providing said blanking punch and said second die aperture in a square configuration.

3. The process of claim 1, above, including the step of providing said blanking punch and said second die aperture in a diamond configuration.

4. The process of claim 1, above, including the step of providing said blanking punch and said second die aperture in a rectangular configuration.

5. The process of claim 1, above, including the step of providing said blanking punch and said second die aperture in the configuration of a parrallelogram.

6. The process of claim 1, above, including the step of providing said blanking punch and said second die aperture int he configuration of a hexagon.

7. The process of claim 1, above, including the step of providing said blanking punch and said second die aperture in the configuration of an octagon.

8. The process of claim 1, above, including the step of providing said blanking punch and said second die aperture int he configuration of a polygon.

9. The process of claim 1, above, including the step of providing said blanking punch and said second die aperture in the configuration of a circle.

10. The process of claim 1, above, including the step of providing said blanking punch and said second die aperture in the configuration of a complex curve.

* * * * *